US005748072A

United States Patent [19]

Wang

[11] Patent Number: 5,748,072

[45] Date of Patent: May 5, 1998

[54] APPARATUS FOR FIRE PROTECTION

[76] Inventor: Hui Wang, 38855 Litchfield Cir., Fremont, Calif. 94536

[21] Appl. No.: 597,955

[22] Filed: Feb. 7, 1996

[51] Int. Cl.[6] ..... G08B 00/00

[52] U.S. Cl. ..... 340/286.05; 52/3; 52/4; 340/288; 340/289

[58] Field of Search ..... 340/286.05, 588, 340/589, 290, 288, 289; 52/3, 4, DIG. 12

[56] References Cited

U.S. PATENT DOCUMENTS

| | | | |
|---|---|---|---|
| 3,715,843 | 2/1973 | Ballinger | 52/3 |
| 3,766,958 | 10/1973 | Mitchell | 160/84.02 |
| 4,858,395 | 8/1989 | McQuirk | 52/3 |
| 5,167,098 | 12/1992 | Blackwelder | 52/90 |
| 5,423,150 | 6/1995 | Hitchcock | 52/1 |

*Primary Examiner*—Jeffery Hofsass
*Assistant Examiner*—Ashok Mannava

[57] ABSTRACT

An apparatus for protecting house or building from fire in neighborhood or area close by is described. When fire detecting system 16 detects a fire at a position close to house 14, computer 20 will send instruction to motor 18 and motor 18 will unfold foldable fire protecting cover 10, 12 to isolate house 14 from outside. At the same time, computer 20 will automatically send a fire alarm to the fire station and a specific phone such as work phone of householder through modem 22. Since fire protecting cover 10, 12 isolates the house from the fire outside, therefore house 14 can be effectively protected. Fire protecting cover 12 also can be remotely controlled by the householder through a telephone 24.

9 Claims, 4 Drawing Sheets

APPARATUS FOR FIRE PROTECTION

TECHNICAL FIELD

The instant invention relates to an apparatus for protecting house or building, especially protecting residential house from a fire in neighborhood or area close by.

BACKGROUND OF THE INVENTION

No one knows when human being started to fight with fire, however everyone knows human being is still fighting with fire today, and is going to fight with fire in the future. In other words, fire fighting is an eternal task for human being.

Table I shows the history of U. S. fire facilities and property damage in fire reported in "Accident Facts", national safety Council, Chicago, 1989, pp.19–21 and "Insurance Facts", 1988–89, Insurance Information Institute, New York, 1989, P.69.

TABLE I

| Year | Fire Deaths | Property Damage (in Millions) | Property Damage (in millions of 1987 Dollars) |
|---|---|---|---|
| 1920 | 9,300 | $448 | $2,544 |
| 1930 | 8,100 | $502 | $3,415 |
| 1940 | 7,500 | $286 | $2,325 |
| 1950 | 6,400 | $649 | $3,059 |
| 1960 | 7,600 | $1,108 | $4,252 |
| 1970 | 6,700 | $2,238 | $6,552 |
| 1980 | 5,800 | $5,579 | $7,691 |
| 1987 | — | $8,504 | $8,504 |
| 1988 | 5,000 | — | — |

From Table I, we can see that the number of fire deaths decreased very slowly from 1920 to 1988, the number of fire deaths in 1988 is 0.54 times of those in 1920. Meanwhile, the property damages increased almost one billion every decade. The property damage in 1987 was as high as 8.5 billion dollars. Let us see another fire disaster in Los angles in autumn (Oct. 26 to Nov. 7) of 1993. This fire disaster shocked residents in California, shocked the people in this country, and also shocked the people in the world. Table II shows the fire deaths and property damages in that disaster reported in "The top 10 stories of 1993", San Jose Mercury News, 3B, Dec. 31, 1993.

TABLE II

| Fire Deaths | Fire Injuries | Property Damage (in Million) | Destroyed Structures | Cost of Fire Fighting (in Million) |
|---|---|---|---|---|
| 4 | 160 | $1,000 | 1,200 | 68 |

Why did Los Angeles's disaster happen? Newspapers and TVs said: there were too much raining during the year of 1993 which made the grasses and trees over growth, those grasses became dry in the autumn therefore easily caught fire; it was strong wind those days which helped fire expanding, and multi-places had fires at the same time; there were no sufficient numbers of fire fighters and fire extinguishers available, et al. Those answers are reasons, but not the real and key reasons. The key reason might be that the fire detecting, protecting and suppressing methods and equipment used currently are not effective and efficient.

Currently, two methods are mostly often used in fire fighting of commercial building and residential house. One method is to use extinguishing chemicals to cover or coat burning materials; to cool the fire; or to inhibit the flame chain reactions. Most of these extinguishing chemicals, such as Halon chemicals and foam, are toxic and harmful to the human being. Halon chemicals has been identified to deplete ozone layer. Furthermore, these extinguishing chemicals is not effective for fighting large-area fire, because it is difficult to deliver a large amount of the extinguishing chemicals to the fire in a short period of time either by airplanes or ground vehicles. Also, to use a large amount of the extinguishing chemicals in fire fighting will cause the environment pollution.

Another method is to use water to suppress fire. This method is a traditional way and is widely used in the building and residential fire fighting. The major advantages of this method are no toxic and low cost. When fire is weak and small, i.e. temperature is low, water will be evaporated into steam, which cools the fire and blankets the fire by reducing the amount of air available. However, when fire is strong, i.e., the temperature is high, water will be resolved into hydrogen and oxygen, in which oxygen helps combustion. The chemical reaction can be written as:

$$H_2O \rightarrow 2H+O$$

$$2O+C \rightarrow CO_2 \qquad (1)$$

From equation (1), we can understand that the resolved oxygen will react with carbon to form carbon dioxide which helps the fire expending. This is why using water to suppress a strong and large area fire needs a very long suppressing time. Usually, properties have been substantially damaged before the fire is suppressed. Furthermore, delivering a lot of water at a short time into the fire in a large area is difficult currently, which is limited by distance between fire station and the fire, the number of the fire extinguisher, and performance of the fire extinguisher. Also, a high speed water jet itself usually will damage the properties, such as electronic equipment, office tool, home furniture and house itself.

SUMMARY OF THE INVENTION

According, the primary object of this invention is to provide an apparatus for protecting residential house or building from a fire in neighborhood or area close by.

An additional object of this invention is to provide an apparatus which protects house or building from a fire without using water or chemicals, therefore it is cost effective and does not cause air pollution.

A further object of this invention is to provide an apparatus which protects house or building from fire automatically.

The above and other objects of the invention is accomplished by the provision of an apparatus for protecting house or building from fire, comprising: a foldable fire protecting cover driven by a driving means, fire detecting system, a computing means, and modem used for connecting to outside phone and fire station. When the fire detecting system detects the fire at a position close to the house, the computer will send instruction to the driving means and the driving means will unfold the foldable fire protecting cover to isolate the house. At the same time, computer will automatically sends a fire alarm to the fire station and a specific phone such as work phone of householder. Since the fire protecting cover isolates the house from the fire outside, therefore the house can be effectively protected. The fire protecting cover also can be remotely controlled by the householder through a telephone. This will significantly improve the safety of the residential houses. If each house had been equipped by such a apparatus, the Los Angeles's fire disaster happened in autumn of 1993 would not have destroyed or damaged so many residential houses. Thus, the property damage loss would have been significantly reduced. This novel invention will start a new technical revolution in protecting house or building from fire. It will significantly improve safety of residential houses. This invention will protect human lives from fire, and save billion of properties lost in the fires every year in United States.

The above and other objects, features and advantages of the present invention will become more apparent from a study of following portions of the specification, the claims and attached drawings.

DESCRIPTION OF PREFERRED EMBODIMENT

In describing the various embodiments of the invention, corresponding parts in different figures are designated with the same reference number in order to minimize repetitive description.

Figure 1A:
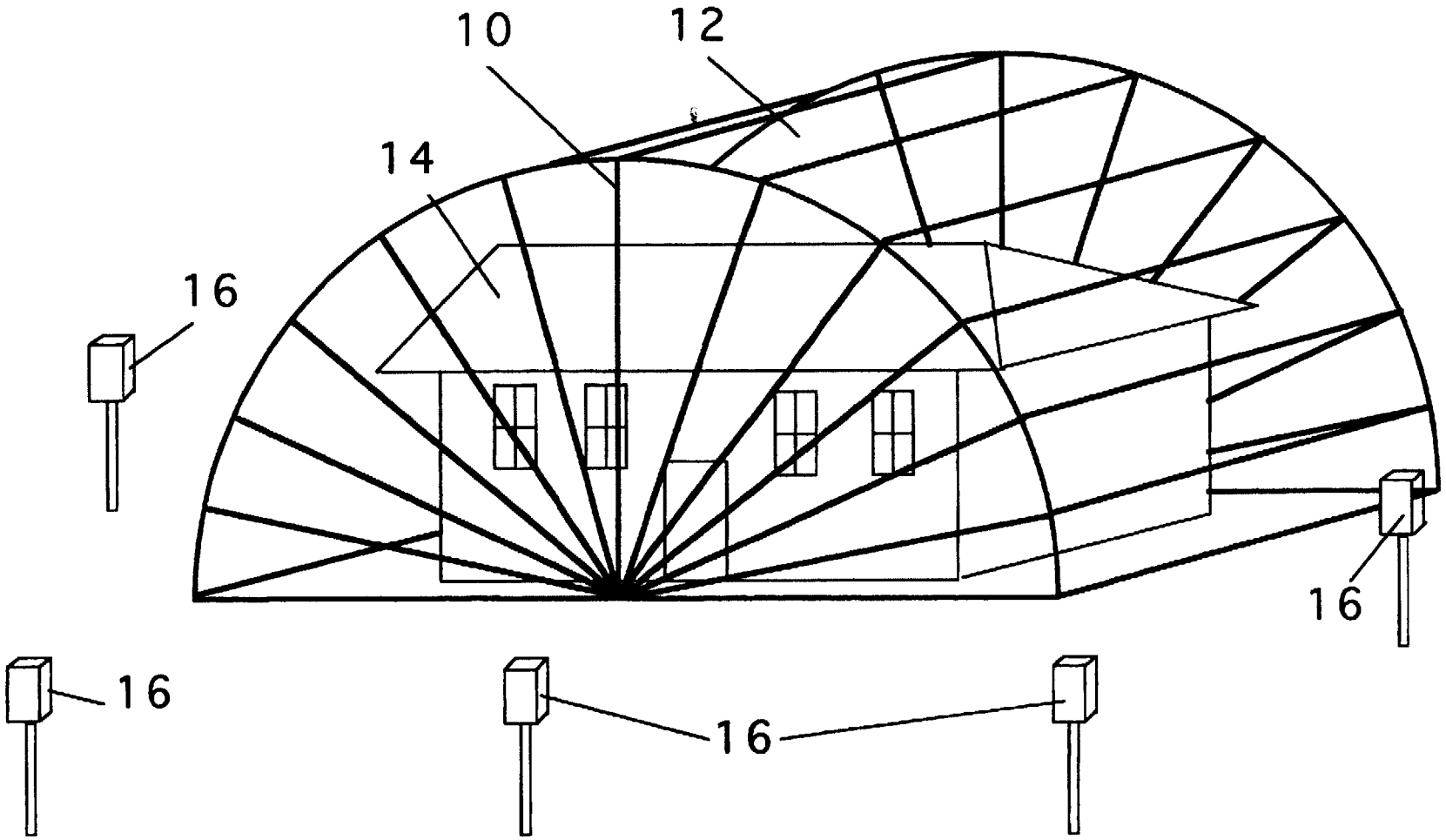
FIGS. 1A and 1B are schematic view of one embodiment of an apparatus for protecting house or building from fire in accordance with the present invention.

FIG. 1A is a three-dimension schematic diagram showing one embodiment of the apparatus for protecting a single residential house 14 from a fire in neighborhood or area close by.

Figure 1B:
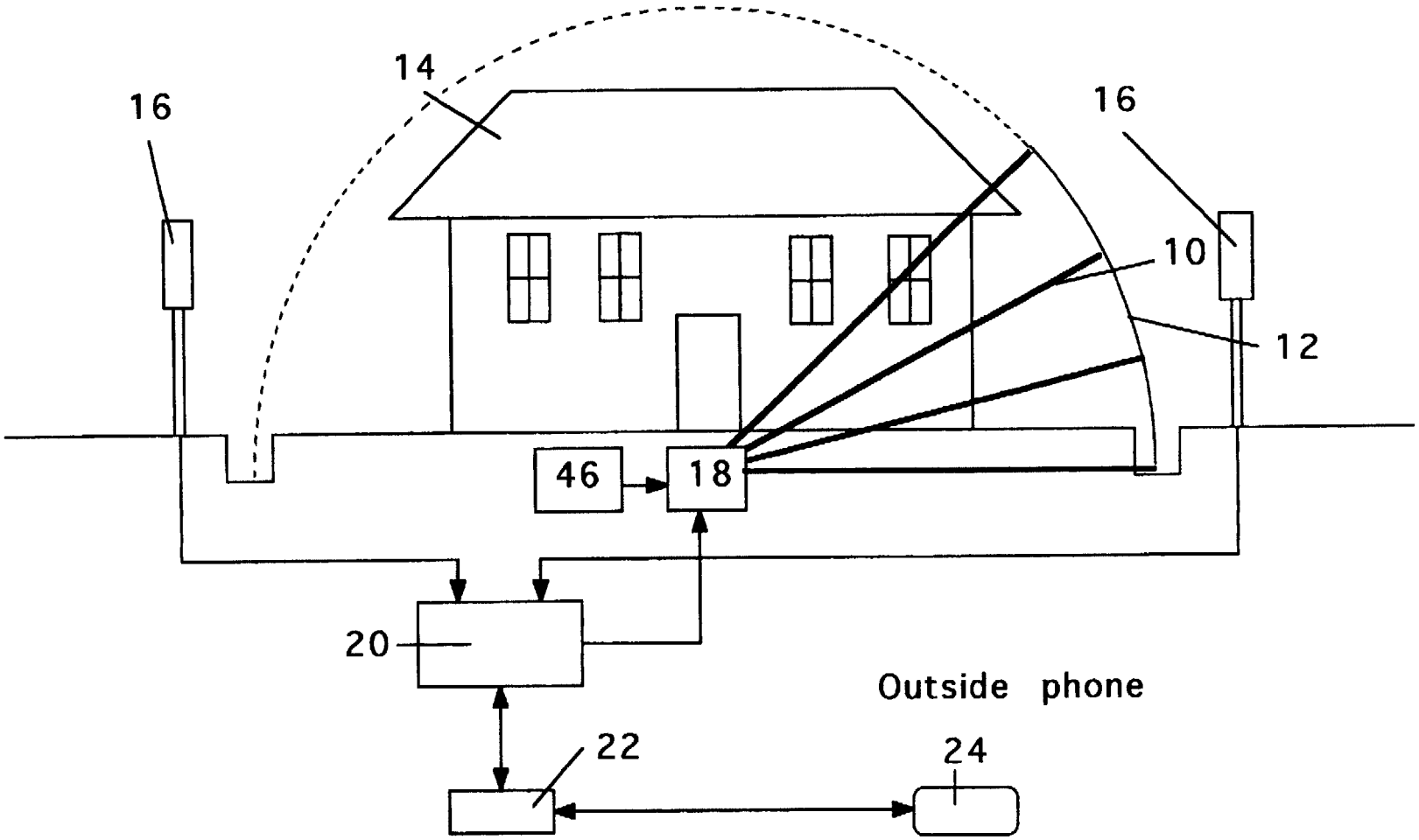

This embodiment, as shown in detailed in FIG. 1B, comprises a foldable frame 10, a cover 12, a motor 18, a fire detecting system 16, a computer 20, a manual switch 46, and a modem 22 connected to an outside phone 24 and a fire station. Fire detecting system 16 consists of a temperature sensor, a flame sensor and a smoke sensor, which can detect fire precisely and fast. Cover 12 is supported by frame 10. Foldable frame 10 can be made of steel, Titanium alloy, or other high-temperature resistant and non-burning materials. Foldable cover 12 can be made of high-temperature and non burning fiber. The distance between foldable fire protecting cover 10, 12 and house 14 should be large than a certain distance, such as 0.2 meter. When fire detecting system 16 detects a fire at a position close to house 14, computer 20 sends instruction to motor 18 and motor 18 unfolds foldable frame 10 and cover 12 to isolate house 14 from outside. At the same time, computer 20 automatically sends a fire alarm to the fire station and a specific phone such as work phone of householder. Since cover 10 isolates the house from the fire outside, therefore house 14 can be effectively protected. Motor 18 also can be remotely controlled by the householder through a telephone. This is very useful and very safe in some cases. For example, if the householder is out of house in vacation or in working and he/she knows a fire happens in an area close to his/her house, he/she can remotely control the fire protecting cover 12 to cover house 14 before the outdoor fire detecting system 16 detects the fire. This will more effectively and safely protect house 14. Motor 18 also can be directly controlled by manual switch 46.

Figure 2A:
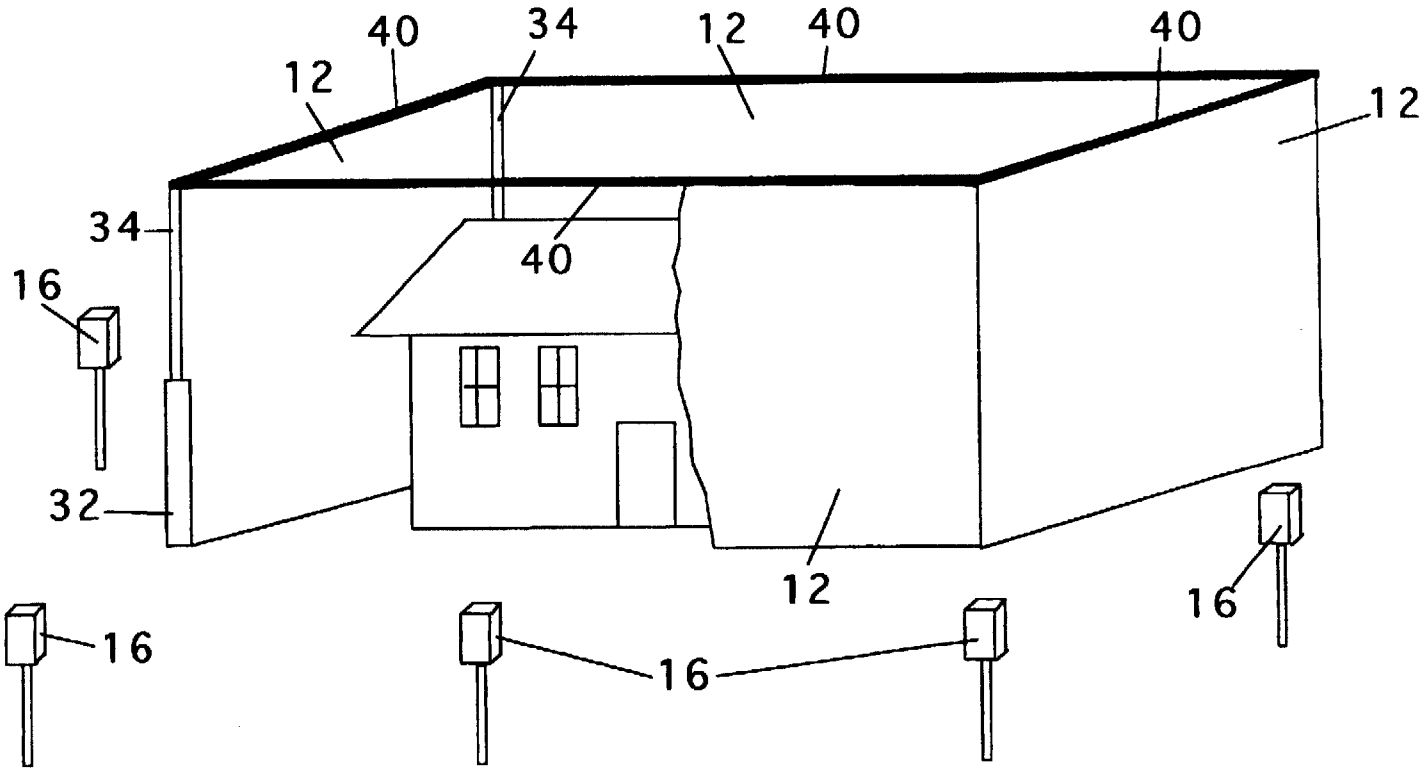
FIGS. 2A and 2B are schematic view of alternative embodiment of an apparatus for protecting house or building from fire in accordance with the present invention.

FIG. 2A is a three-dimension schematic diagram showing alternative embodiment of the apparatus for protecting a single residential house 14 from a fire in neighborhood or area close by.

Figure 2B:
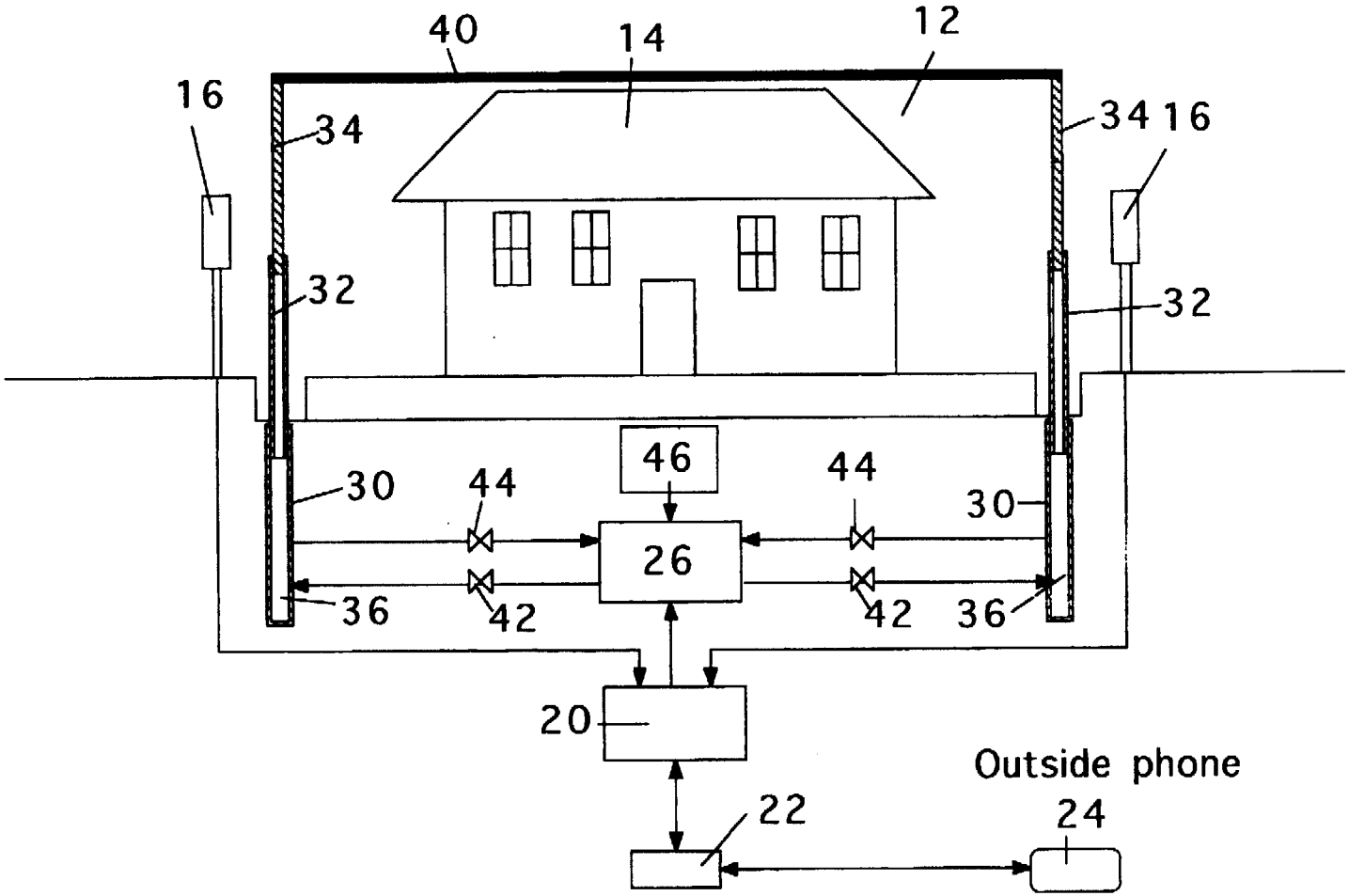

This embodiment, as shown in detailed in FIG. 2B, comprises a foldable frame 40, a cover 12, four extendible cylinders 30, a pressure pump 26, a fire detecting system 16, a manual switch 46, a computer 20, and a modem 22 connected to an outside phone 24 and a fire station. Cover 12 is supported by frame 40. The foldable frame 40 can be made of steel, Titanium alloy, or other high-temperature resistant and non-burning materials. Each extendible cylinder 30 comprises three sub-cylinders with different diameters, larger one sleeves smaller one. Pump 26 supplies positive pressure fluid 36 to cylinders 30 to extend cylinders 30, and supplies negative pressure fluid to cylinders 30 to draw back cylinders 30. A valve 42 is set outlet of pump, and a valve 44 is set inlet of pump. When pump 26 supplies positive pressure fluid, valve 44 is turned off and valve 42 is turned on. When pump supplies negative pressure fluid, valve 44 is turned on and valve 42 is turned off. Valves 42 and 44 will be turned off by itself if electricity is shut down. This ensures the foldable frame 40 and cover 12 be kept at the position after being raised up even the electricity is shut down. Fluid 36 can be oil, water, anti-freeze water or fluid. The distance between foldable fire protecting cover 40, 12 and house 14 should be large than a certain distance, such as 0.2 meter. The height of cover 12 should be higher than the height of house 14. When fire detecting system 16 detects a fire at a position close to house 14, computer 20 sends an instruction to pump 26 and pump 26 supplies positive pressure fluid to cylinders 30, and cylinders 30 unfolds foldable fire protecting cover 40, 12 to isolate house 14 from outside. Pump 26 can be controlled by manual switch 46. It is to be understood that the embodiment described herein is merely illustrative of the principle of the invention. Various modifications and changes may be made thereto by persons skilled in the art which will embody the principle of the invention and fall within the spirit and scope thereof. For example, the shape of the fire protecting cover can be triangle, semicircle, or polygon, and the fire protecting cover can be unfolded either manually or automatically.

What is claimed is:

1. An apparatus for fire protection, comprising:

a foldable frame provided outside of a house or building;

a covering means supported by said foldable frame;

a driving means for unfolding said foldable frame and said covering means to isolate said house or building from outside;

a fire detecting means provided outside of said house or building for detecting fire;

a computing means for collecting fire information from said fire detecting means, for sending commands to said driving means to unfold or fold said foldable frame and said covering means.

2. An apparatus as defined in claim 1, wherein said foldable frame is made of non burning materials.

3. An apparatus as defined in claim 1, wherein said covering means is made of non burning fiber.

4. An apparatus as defined in claim 1, wherein distance between said cover and said house or building is longer than 0.2 meter.

5. An apparatus as defined in claim 1, wherein said fire detecting means comprises the smoking sensor, temperature sensor, and flame sensor.

6. An apparatus as defined in claim 1, wherein said driving means is an electrical motor.

7. An apparatus as defined in claim 1, wherein said driving means comprises at least two extendible cylinders, a pump, a inlet valve, and a outlet valve, said pump supplies positive pressure fluid through said inlet valve to said cylinders to extend said cylinders, and supplies negative pressure fluid through said outlet valve to said cylinders to draw back said cylinders, said inlet valve and said outlet valve are turned off by themselves when electricity is shut down.

8. An apparatus as defined in claim 1, further comprising a modem connecting said computing means with outside phone line, for sending fire alarm to a fire station, and for getting remote instruction from outside.

9. An apparatus as defined in claim 1, further comprising a manual switch to instruct said driving means to unfold or fold said foldable frame and said covering means.

* * * * *